US010260499B2

(12) United States Patent
Rosner

(10) Patent No.: US 10,260,499 B2
(45) Date of Patent: Apr. 16, 2019

(54) MODULAR MULTI-PUMP SYSTEM WITH PRESSURE CONTROL

(71) Applicant: UNITED TECHNOLOGIES CORPORATION, Farmington, CT (US)

(72) Inventor: Jason E. Rosner, Southington, CT (US)

(73) Assignee: UNITED TECHNOLOGIES CORPORATION, Farmington, CT (US)

( * ) Notice: Subject to any disclaimer, the term of this patent is extended or adjusted under 35 U.S.C. 154(b) by 344 days.

(21) Appl. No.: 15/242,208

(22) Filed: Aug. 19, 2016

(65) Prior Publication Data

US 2018/0051689 A1 Feb. 22, 2018

(51) Int. Cl.

| | |
|---|---|
| ***F04B 49/08*** | (2006.01) |
| ***F04B 49/00*** | (2006.01) |
| ***F04B 23/04*** | (2006.01) |
| ***F04B 41/06*** | (2006.01) |
| ***F04B 49/22*** | (2006.01) |

(Continued)

(52) U.S. Cl.

CPC ..... *F04B 49/007* (2013.01); *F04B 23/04* (2013.01); *F04B 41/06* (2013.01); *F04B 49/08* (2013.01); *F04B 49/22* (2013.01); *F04B 49/225* (2013.01); *F04B 49/24* (2013.01); *F15B 11/0426* (2013.01); *F15B 11/17* (2013.01); *F15B 2211/20538* (2013.01); *F15B 2211/20576* (2013.01); *F15B 2211/25* (2013.01); *F15B 2211/265* (2013.01); *F15B 2211/50536* (2013.01); *F15B 2211/6309* (2013.01)

(58) Field of Classification Search

CPC ..... F04B 49/007; F04B 49/08; F04B 23/04; F15B 11/17

See application file for complete search history.

(56) References Cited

U.S. PATENT DOCUMENTS

| | | | |
|---|---|---|---|
| 4,345,436 | A | 8/1982 | Johnson |
| 4,850,813 | A | 7/1989 | Fisher |

(Continued)

FOREIGN PATENT DOCUMENTS

| | | |
|---|---|---|
| EP | 2568182 | 3/2013 |
| WO | 0060239 | 10/2000 |

OTHER PUBLICATIONS

European Patent Office, European Search Report dated Feb. 8, 2018 in Application No. 17184516.7-1004.

*Primary Examiner* — Kevin F Murphy
(74) *Attorney, Agent, or Firm* — Snell & Wilmer, L.L.P.

(57) ABSTRACT

A modular multi-pump system is provided. The modular multi-pump system may comprise a plurality of modular pump systems. A modular pump system may comprise a pump, at least one backpressure orifice, a pressure regulating valve (PRV), and a mix valve. The pump may receive and pump a fluid through the modular multi-pump system. The at least one backpressure orifice may set a desired fluid output pressure for the fluid flow. The pressure regulating valve may maintain modular pump system fluid output pressure in response to being in a balanced position, and may initiate fluid flow transition to the next modular pump system in response to being in a transition position. The mix valve may prevent fluid flow from the next modular pump system in response to being in a first position, and enable fluid flow from the next modular pump system in response to being in a second position.

20 Claims, 8 Drawing Sheets

(51) Int. Cl.

| | |
|---|---|
| ***F04B 49/24*** | (2006.01) |
| ***F15B 11/17*** | (2006.01) |
| ***F15B 11/042*** | (2006.01) |

(56) References Cited

U.S. PATENT DOCUMENTS

| | | | |
|---|---|---|---|
| 8,616,858 | B2 | 12/2013 | Rosner |
| 2012/0156061 | A1 | 6/2012 | Baker |

MODULAR MULTI-PUMP SYSTEM WITH PRESSURE CONTROL

FIELD

The present disclosure relates to pump control systems for regulating fluid control, and more specifically, to a modular multi-pump system with pressure control.

BACKGROUND

Hydraulic and/or fueldraulic pump systems may be utilized to satisfy variable pressure flow demands in a variety of flow applications, including fuel, lubrication, and hydraulic actuation systems. Such applications often utilize a large pump system capable of providing sufficient fluid flow for large, rapidly changing flow demands of irregular occurrence. Due to the rapidly changing flow demands, the large pump system may also require a quick transient response to a sudden increase in pressure and flow demand. When a large flow demand is not present, fluid may be bypassed to a pump supply, reservoir, and/or the like. Operating a pump system at high bypass levels (e.g., when a large flow demand is not present) is inefficient and generates unnecessary excess heat. The thermal problem may be further exacerbated when a high pressure is set for the pump system.

SUMMARY

In various embodiments, a modular pump system is disclosed. The modular pump system may comprise a pump, a pressure regulating valve, and a mix valve. The pump may be configured to provide a fluid flow through the modular pump system. The pressure regulating valve may be configured to move between a balanced position and a transition position, wherein in the balanced position the pressure regulating valve may maintain a fluid output pressure for the modular pump system, and in the transition position the pressure regulating valve may initiate a fluid flow transition to a second modular pump system. The mix valve may be configured to move between a first position and a second position, wherein in the first position the mix valve may prevent fluid flow from the second modular pump system, and in the second position the mix valve may enable fluid flow from the second modular pump system.

In various embodiments, the modular pump system may also comprise a first backpressure orifice and a second backpressure orifice configured to maintain a fluid pressure on the pressure regulating valve. In various embodiments, the modular pump system may also comprise a regulator control assembly to control fluid flow to an outlet. The regulator control assembly may comprise a pressure sensing element, a controller, and a variable flow port. In various embodiments, the pressure regulating valve and the mix valve may each comprise spool valves movable within a cavity in response to a fluid pressure applied at each end. In various embodiments, the pressure regulating valve may comprise a primary bypass control window and a secondary bypass control window configured to selectively allow fluid flow through the pressure regulating valve. In various embodiments, the mix valve may comprise a primary control window and a secondary control window configured to selectively allow fluid flow through the mix valve.

In various embodiments, a modular component system is disclosed. The modular component system may comprise a pump component module and a mix component module. The pump component module may comprise a pump, a pressure regulating valve, and a first backpressure orifice and a second backpressure orifice. The pump may be configured to provide a fluid flow through the pump component module. The pressure regulating valve may be configured to move between a balanced position and a transition position, wherein in the balanced position the pressure regulating valve may maintain a fluid output pressure for the pump component module, and in the transition position the pressure regulating valve may initiate a fluid flow transition to a second modular pump system. The first backpressure orifice and the second backpressure orifice may be configured to maintain a fluid pressure on the pressure regulating valve. The mix component module may comprise a mix valve. The mix valve may be configured to move between a first position and a second position, wherein in the first position the mix valve prevents fluid flow from the second modular pump system, and in the second position the mix valve enables fluid flow from the second modular pump system.

In various embodiments, the module component system may further comprise a regulator control assembly to control fluid flow to an outlet. The regulator control assembly may comprise a pressure sensing element, a controller, and a variable flow port. In various embodiments, the pressure regulating valve and the mix valve may each comprise spool valves movable within a cavity in response to a fluid pressure applied at each end. In various embodiments, the pressure regulating valve may comprise a primary bypass control window and a secondary bypass control window configured to selectively allow fluid flow through the pressure regulating valve. In various embodiments, the mix valve may comprise a primary control window and a secondary control window configured to selectively allow fluid flow through the mix valve.

In various embodiments, a modular multi-pump system is disclosed. The modular multi-pump system may comprise at least one modular pump system and a pump component module. The at least one modular pump system may comprise a pump, a pressure regulating valve, and a mix valve. The pump may be configured to provide a first fluid flow through the at least one modular pump system. The pressure regulating valve may be configured to move between a balanced position and a transition position, wherein in the balanced position the pressure regulating valve may maintain a fluid output pressure for the at least one modular pump system, and in the transition position the pressure regulating valve may initiate a fluid flow transition. The mix valve may be configured to move between a first position and a second position, wherein in the first position the mix valve may prevent flow of a second fluid flow, and in the second position the mix valve may enable flow of the second fluid flow. The pump component module may comprise a pump, a component pressure regulating valve, and a first backpressure orifice and a second backpressure orifice. The pump may be configured to provide the second fluid flow through the pump component module. The component pressure regulating valve may be configured to move between a balanced position and a transition position, wherein in the balanced position the component pressure regulating valve may maintain a fluid output pressure for the pump component module, and in the transition position the pressure regulating valve may initiate a fluid flow to a pump supply. The first backpressure orifice and the second backpressure orifice may be configured to maintain a fluid pressure on the component pressure regulating valve.

In various embodiments, the modular multi-pump system may further comprise a regulator control assembly to control fluid flow to an outlet. The regulator control assembly may comprise a pressure sensing element, a controller, and a variable flow port. In various embodiments, the pressure regulating valve, the component pressure regulating valve, and the mix valve may each comprise spool valves movable within a cavity in response to a fluid pressure applied at each end. In various embodiments, the pressure regulating valve and the component pressure regulating valve may each comprise a primary bypass control window and a secondary bypass control window configured to selectively allow fluid flow through the valve. In various embodiments, the mix valve may comprise a primary control window and a secondary control window configured to selectively allow fluid flow through the valve. In various embodiments, the pump supply may comprise at least one of an inner stage pump, a boost pump, a fluid supply tank, or a bypass flow tank.

The forgoing features and elements may be combined in various combinations without exclusivity, unless expressly indicated herein otherwise. These features and elements as well as the operation of the disclosed embodiments will become more apparent in light of the following description and accompanying drawings.

BRIEF DESCRIPTION OF THE DRAWINGS

The subject matter of the present disclosure is particularly pointed out and distinctly claimed in the concluding portion of the specification. A more complete understanding of the present disclosure, however, may best be obtained by referring to the detailed description and claims when considered in connection with the following illustrative figures. In the following figures, like reference numbers refer to similar elements and steps throughout the figures.

Elements and steps in the figures are illustrated for simplicity and clarity and have not necessarily been rendered according to any particular sequence. For example, steps that may be performed concurrently or in different order are illustrated in the figures to help to improve understanding of embodiments of the present disclosure.

DETAILED DESCRIPTION

The detailed description of exemplary embodiments herein makes reference to the accompanying drawings, which show exemplary embodiments by way of illustration. While these exemplary embodiments are described in sufficient detail to enable those skilled in the art to practice the disclosures, it should be understood that other embodiments may be realized and that logical changes and adaptations in design and construction may be made in accordance with this disclosure and the teachings herein. Thus, the detailed description herein is presented for purposes of illustration only and not of limitation.

The scope of the disclosure is defined by the appended claims and their legal equivalents rather than by merely the examples described. For example, the steps recited in any of the method or process descriptions may be executed in any order and are not necessarily limited to the order presented. Furthermore, any reference to singular includes plural embodiments, and any reference to more than one component or step may include a singular embodiment or step. Also, any reference to attached, fixed, coupled, connected or the like may include permanent, removable, temporary, partial, full and/or any other possible attachment option. Additionally, any reference to without contact (or similar phrases) may also include reduced contact or minimal contact. Surface shading lines may be used throughout the figures to denote different parts but not necessarily to denote the same or different materials.

Figure 1:
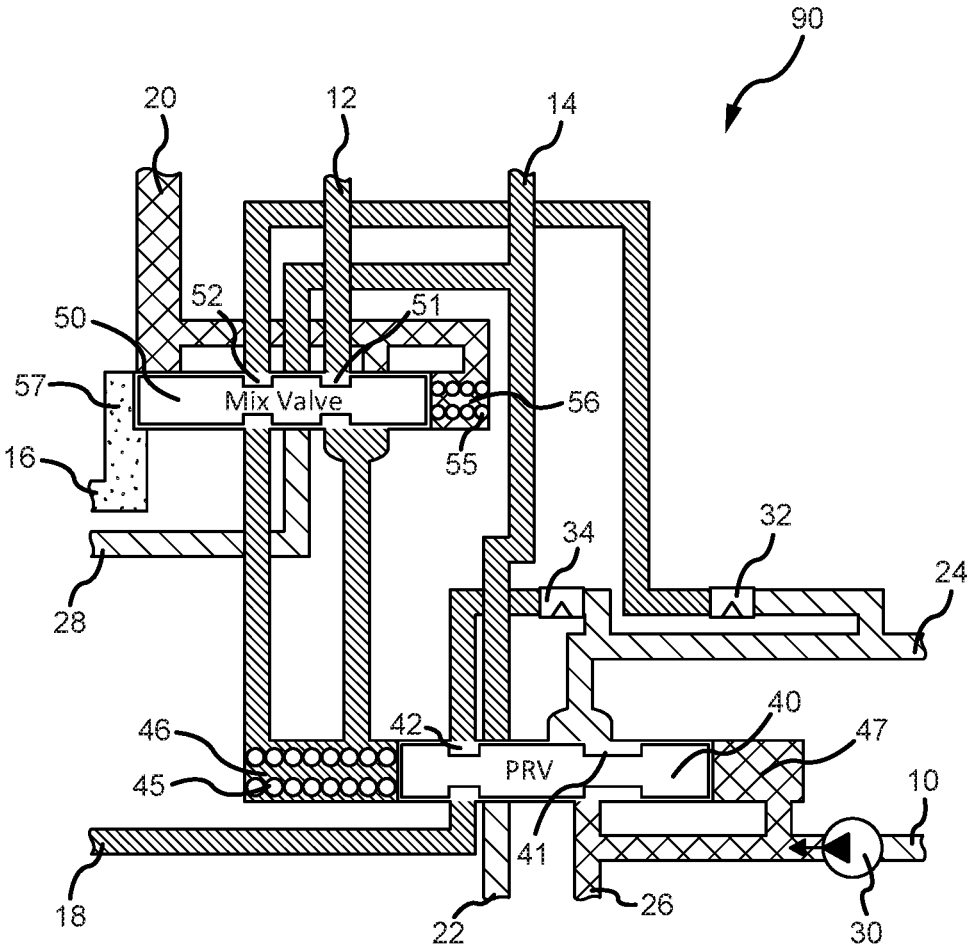
FIG. 1 illustrates a schematic view of a modular pump system, in accordance with various embodiments.

In various embodiments, and with reference to FIG. 1, a modular pump system 90 is schematically illustrated. Modular pump system 90 may be configured to output fluid flow based on a fluid flow demand. Fluid flow may comprise any suitable and/or desired fluid, such as, for example, fuel or hydraulic fluid. Modular pump system 90 may have a pump capacity, e.g., a maximum fluid flow modular pump system 90 is capable of outputting. In that regard, modular pump system 90 may comprise the pump capacity of about 5 gallons per a minute (GPM) (18.9 liters per a minute (LPM)) to about 50 GPM (189.3 LPM), about 10 GPM (37.85 LPM) to about 20 GPM (75.7 LPM), about 20 GPM (75.7 LPM) to about 40 GPM (151.4 LPM), and/or about 40 GPM (151.4 LPM) to about 50 GPM (189.3 LPM) (wherein about in this context refers only to +/−2 GPM (7.6 LPM)). Modular pump system 90 may comprise a plurality of inlet pipes (e.g., a first inlet 10, a second inlet 12, a third inlet 14, a fourth inlet 16, and/or a fifth inlet 18) and a plurality of outlet pipes (e.g., a first outlet 20, a second outlet 22, a third outlet 24, a fourth outlet 26, and/or a fifth outlet 28) configured to provide a fluid flow passage through modular pump system 90. The inlet pipes and the outlet pipes of modular pump system 90 may connect in various combinations with each other and/or separate modular pump systems to form a multi-pump sequence (e.g., modular multi-pump system 397, with brief reference to FIG. 3A).

For example, and in various embodiments, first inlet 10 may be configured to provide fluid flow to a pump 30. Pump 30 may comprise any suitable pump, such as, for example, a positive displacement pump. Pump 30 may be configured to receive fluid flow, via first inlet 10, from any suitable source, such as, for example, a pump supply 375 (with brief reference to FIG. 3A). Pump supply 375 may comprise any suitable source of fluid, such as, for example, an inner stage pump, a fluid supply tank, a boost pump, a bypass flow tank, and/or the like.

In various embodiments, second inlet 12 may be configured to receive fluid flow from different sources dependent on the position of modular pump system 90 in a multi-pump sequence. For example, in response to modular pump system 90 being the first pump in the multi-pump sequence (e.g., modular pump system 390-1, with brief reference to FIG. 3A), second inlet 12 may receive fluid flow from a variable flow port 366. In response to modular pump system 90 not being the first pump in the multi-pump sequence (e.g., modular pump system 390-2, with brief reference to FIG. 3A), second inlet 12 may receive fluid flow from second outlet 22 of a preceding modular pump system (e.g., modular pump system 390-1).

Figure 3A:
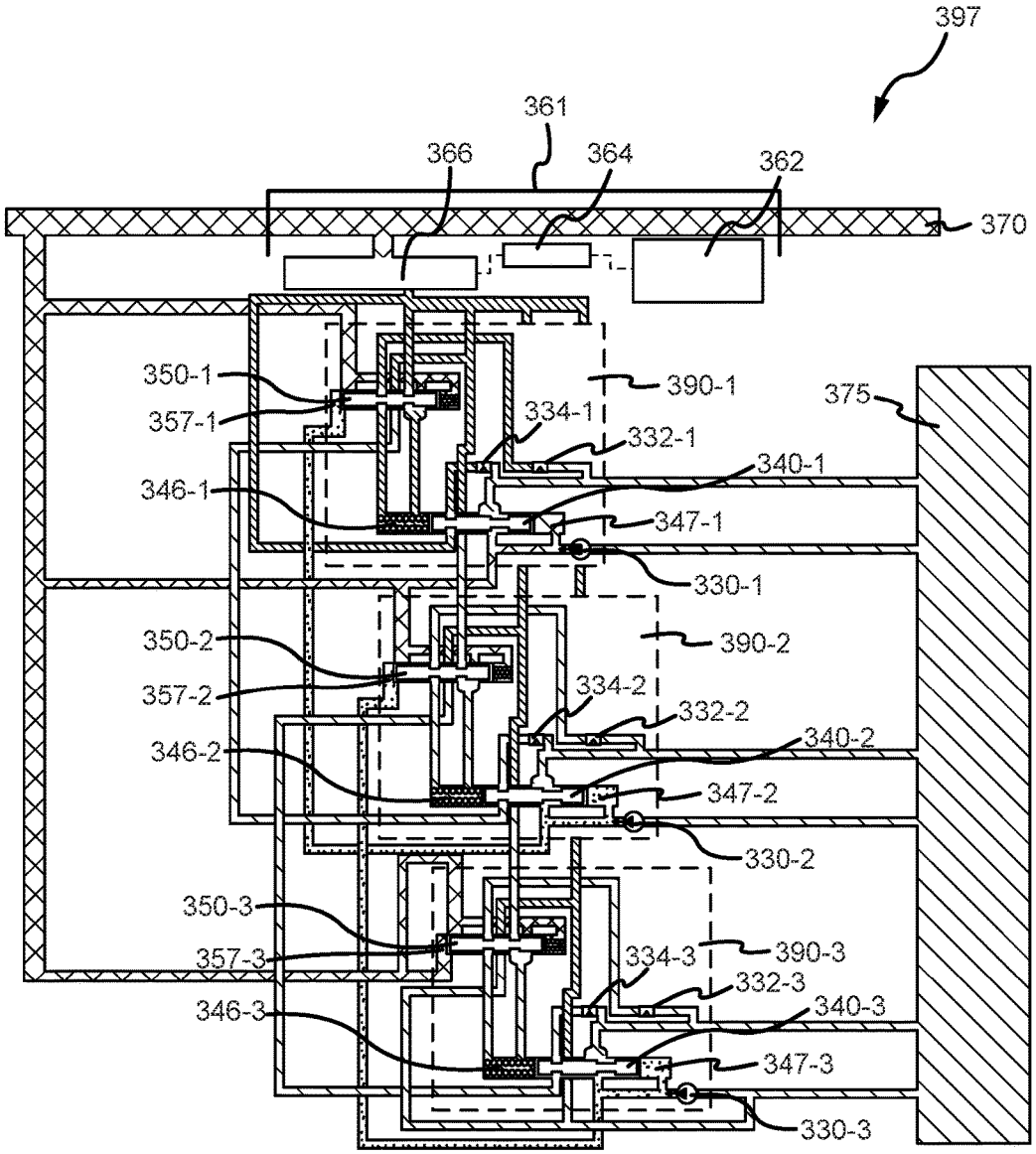
FIG. 3A illustrates a schematic view of a modular multi-pump system with a first modular pump system providing fluid flow, in accordance with various embodiments.

In various embodiments, third inlet 14 may be configured to receive fluid flow from any suitable source, such as from variable flow port 366, with brief reference to FIG. 3A.

In various embodiments, fourth inlet 16 may be configured to receive fluid flow from different sources dependent on the position of modular pump system 90 in a multi-pump sequence. For example, in response to modular pump system 90 being the last pump in the multi-pump sequence (e.g., modular pump system 390-3, with brief reference to FIG. 3A), fourth inlet 16 may receive fluid flow from high pressure fluid flow source, such as flow demand outlet 370. In response to modular pump system 90 not being the last pump in the multi-pump sequence (e.g., modular pump system 390-2, with brief reference to FIG. 3A), fourth inlet 16 may receive fluid flow from fourth outlet 26 of a succeeding modular pump system (e.g., modular pump system 390-3, with brief reference to FIG. 3A).

In various embodiments, fifth inlet 18 may be configured to receive fluid flow from different sources dependent on the position of modular pump system 90 in a multi-pump sequence. For example, in response to modular pump system 90 being the first pump in the multi-pump sequence (e.g., modular pump system 390-1, with brief reference to FIG. 3A), fifth inlet 18 may receive fluid flow from variable flow port 366, with brief reference to FIG. 3A. For example, in response to modular pump system 90 not being the first pump in the multi-pump sequence (e.g., modular pump system 390-2, with brief reference to FIG. 3A), fifth inlet 18 may receive fluid flow from fifth outlet 28 of a preceding modular pump system (e.g., modular pump system 390-1, with brief reference to FIG. 3A).

In various embodiments, first outlet 20 may be configured to provide fluid flow to any suitable source, such as to flow demand outlet 370, with brief reference to FIG. 3A. In that regard, first outlet 20 may provide fluid flow, via flow demand outlet 370, to a desired flow consumer, such as a hydraulic actuation, fuel delivery, and/or lubrication system.

In various embodiments, second outlet 22 may be configured to provide fluid flow to different sources dependent on the position of modular pump system 90 in a multi-pump sequence. For example, in response to modular pump system 90 being the last pump in the multi-pump sequence (e.g., modular pump system 390-3, with brief reference to FIG. 3A), second outlet 22 may provide fluid flow to pump supply 375. Second outlet 22 may also be capped to prevent the flow of fluid flow from second outlet 22. In response to modular pump system 90 not being the last pump in the multi-pump sequence (e.g., modular pump system 390-1, with brief reference to FIG. 3A), second outlet 22 may provide fluid flow to second inlet 12 of a succeeding modular pump system (e.g., modular pump system 390-2, with brief reference to FIG. 3A).

In various embodiments, third outlet 24 may be configured to provide fluid flow to any suitable source, such as, for example, pump supply 375 (with brief reference to FIG. 3A).

In various embodiments, fourth outlet 26 may be configured to provide fluid flow to different sources dependent on the position of modular pump system 90 in a multi-pump sequence. For example, in response to modular pump system 90 being the first pump in the multi-pump sequence (e.g., modular pump system 390-1, with brief reference to FIG. 3A), fourth outlet 26 may be configured to provide fluid flow to flow demand outlet 370, and/or any other desired flow consumer. In response to modular pump system 90 not being the first pump in the multi-pump sequence (e.g., modular pump system 390-2, with brief reference to FIG. 3A), fourth outlet 26 may provide fluid flow to fourth inlet 16 of a preceding modular pump system (e.g., modular pump system 390-1, with brief reference to FIG. 3A).

In various embodiments, fifth outlet 28 may be configured to provide fluid flow to different sources dependent on the position of modular pump system 90 in a multi-pump sequence. For example, in response to modular pump system 90 being the last pump in the multi-pump sequence (e.g., modular pump system 390-3, with brief reference to FIG. 3A), fifth outlet 28 may be configured to provide fluid flow to pump supply 375. In response to modular pump system 90 not being the last pump in the multi-pump sequence (e.g., modular pump system 390-1, with brief reference to FIG. 3A), fifth outlet 28 may provide fluid flow to fifth inlet 18 of a succeeding modular pump system (e.g., modular pump system 390-2, with brief reference to FIG. 3A).

In various embodiments, modular pump system 90 may comprise a first backpressure orifice 32 and a second backpressure orifice 34. First backpressure orifice 32 and second backpressure orifice 34 may comprise any suitable device capable of setting and controlling fluid pressure, such as, for example, a fixed orifice. First backpressure orifice 32 and second backpressure orifice 34 may be configured to set a desired fluid pressure for passage 46. In that regard, first backpressure orifice 32 and second backpressure orifice 34 may also be configured to continually maintain fluid pressure on PRV 40, via passage 46, so that fluid pressure is maintained during transition of a first modular pump system to a second modular pump system, for example.

In various embodiments, modular pump system 90 may comprise a pressure regulating valve (PRV) 40. PRV 40 may comprise a primary bypass control window 41 and a secondary bypass control window 42 configured to selectively allow fluid flow through PRV 40. Modular pump system 90 may also comprise a PRV biasing member 45 located in passage 46 configured to exert a biasing force against PRV 40. PRV 40 may comprise a spool valve configured to move within a corresponding chamber responsive to a pressure differential. In various embodiments, PRV 40 may move responsive to changes in fluid flow demand. In that regard, PRV 40 may move from a balanced position to a transition position. The pressure differential between fluid pressure in a passage 47 and fluid pressure combined with a biasing force provided by PRV biasing member 45 in passage 46 moves PRV 40 between a balanced position and a transition position.

In the balanced position, PRV 40 may be configured to maintain modular pump system 90 fluid flow output pressure to a desired value. For example, in the balanced position, as depicted in FIG. 1, fluid may flow from first inlet 10, via pump 30, through primary bypass control window 41 and to third outlet 24. Fluid may also flow from fifth inlet 18 through secondary bypass control window 42 and to second backpressure orifice 34.

In the transition position, PRV 40 may be configured to initiate transition to the next modular pump system in a multi-pump sequence. For example, in the transition position, when a biasing force provided by fluid pressure in passage 47 is less than the sum of forces provided by biasing member 45 and fluid pressure in passage 46 (e.g., as depicted in modular pump system 390-1, with brief reference to FIG. 3B), fluid may flow from third inlet 14, through secondary bypass control window 42, and out second outlet 22 (to the next sequential modular pump system in a multi-pump sequence). Primary bypass control window 41 may then be in a position blocking fluid flow. In various embodiments, PRV 40 may also utilize a damping orifice to ensure a stable dynamic response to variable pressure fluid flow demands.

In various embodiments, modular pump system 90 may comprise a mix valve 50. Mix valve 50 may comprise a primary control window 51 and a secondary control window 52 configured to allow for fluid flow through mix valve 50. Modular pump system 90 may also comprise a mix valve biasing member 55 located in passage 56 and configured to exert a biasing force against mix valve 50. Mix valve 50 may comprise a spool valve configured to move within a corresponding chamber responsive to a pressure differential. In various embodiments, mix valve 50 may move responsive to changes in fluid flow demand. In that regard, mix valve 50 may move from a first position to a second position. The pressure differential between fluid pressure in a passage 57 and fluid pressure combined with a biasing force provided by mix valve biasing member 55 in passage 56 moves mix valve 50 between the first position and the second position.

In the first position, mix valve 50 may be configured to prevent fluid flow from the next sequential modular pump system in a multi-pump sequence until the fluid flow is needed. The first position may also maintain a balanced fluid pressure through first backpressure orifice 32 and second backpressure orifice 34. For example, in the first position, as depicted in FIG. 1, fluid may flow from second inlet 12, through primary control window 51.

In the second position, mix valve 50 may be configured to enable fluid flow from the next sequential modular pump system in a multi-pump sequence, and to increase fluid pressure in passage 46 so that PRV 40 does not regulate the next sequential modular pump system. For example, in the second position, when the differential pressure is greater in passage 57 than in passage 46 (e.g., as depicted in modular pump system 390-1, with brief reference to FIG. 3C), fluid may flow from fourth inlet 16 and out first outlet 20 (to flow demand outlet 375). Fluid may also flow from second inlet 12, through primary control window 51, through passage 46, through secondary control window 52, and to first backpressure orifice 32. Fluid may also flow from third inlet 14, through secondary control window 52, and out fifth outlet 28. In various embodiments, mix valve 50 may also utilize a damping orifice to ensure a stable dynamic response to variable pressure fluid flow demands.

Figure 2:
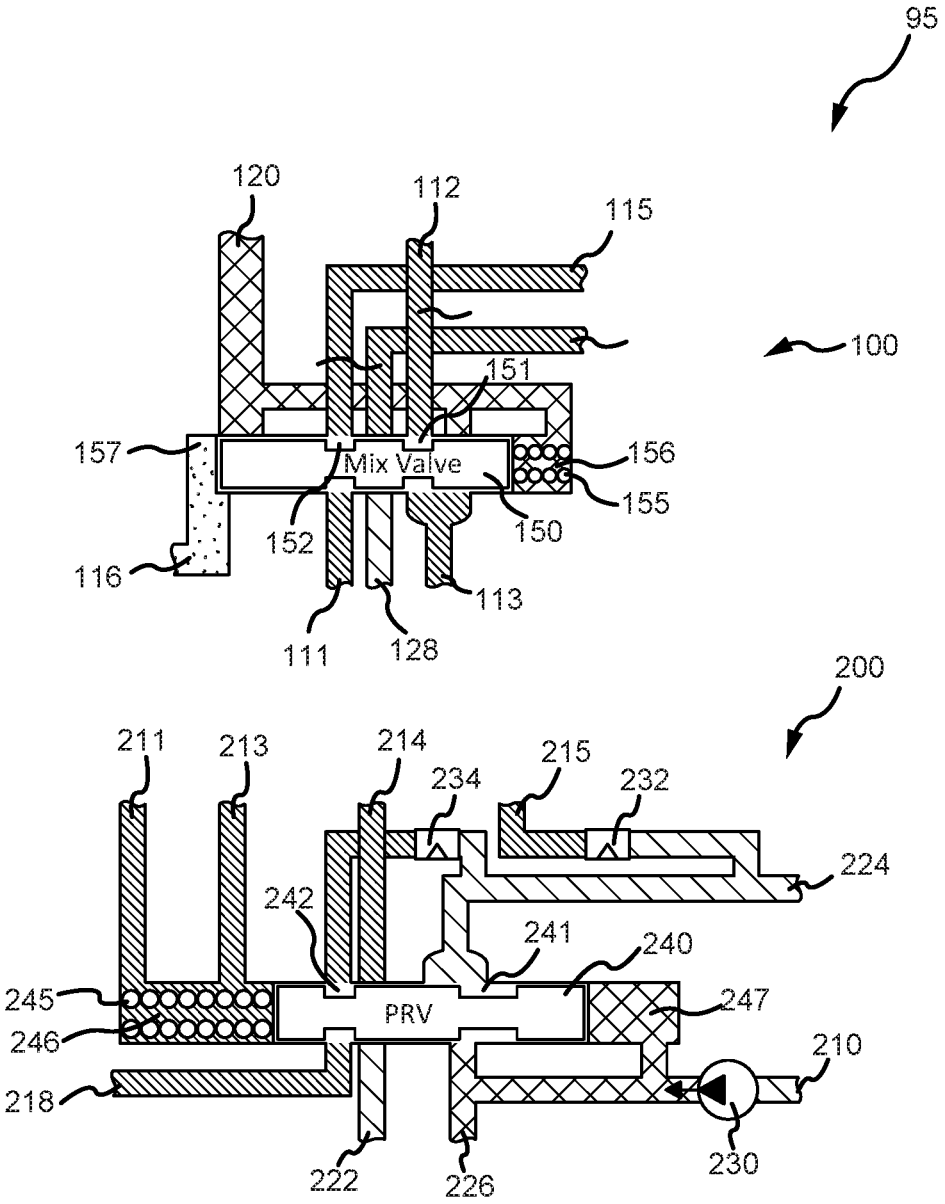
FIG. 2 illustrates a schematic view of a modular component system, in accordance with various embodiments.
Figure 3E:
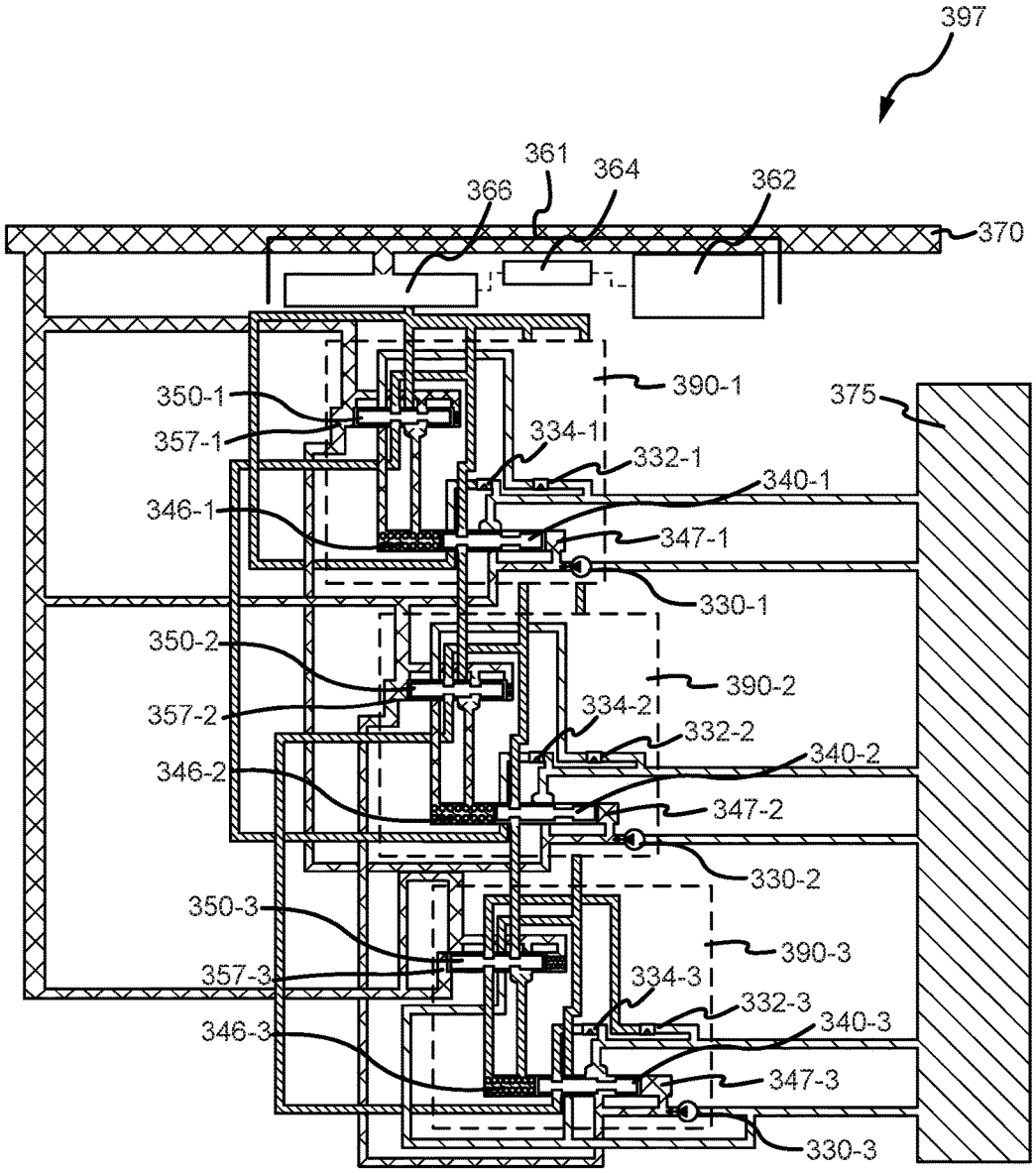
FIG. 3E illustrates a schematic view of a modular multi-pump system with the first modular pump system, the second modular pump system, and the third modular pump system providing fluid flow, in accordance with various embodiments.
Figure 4:
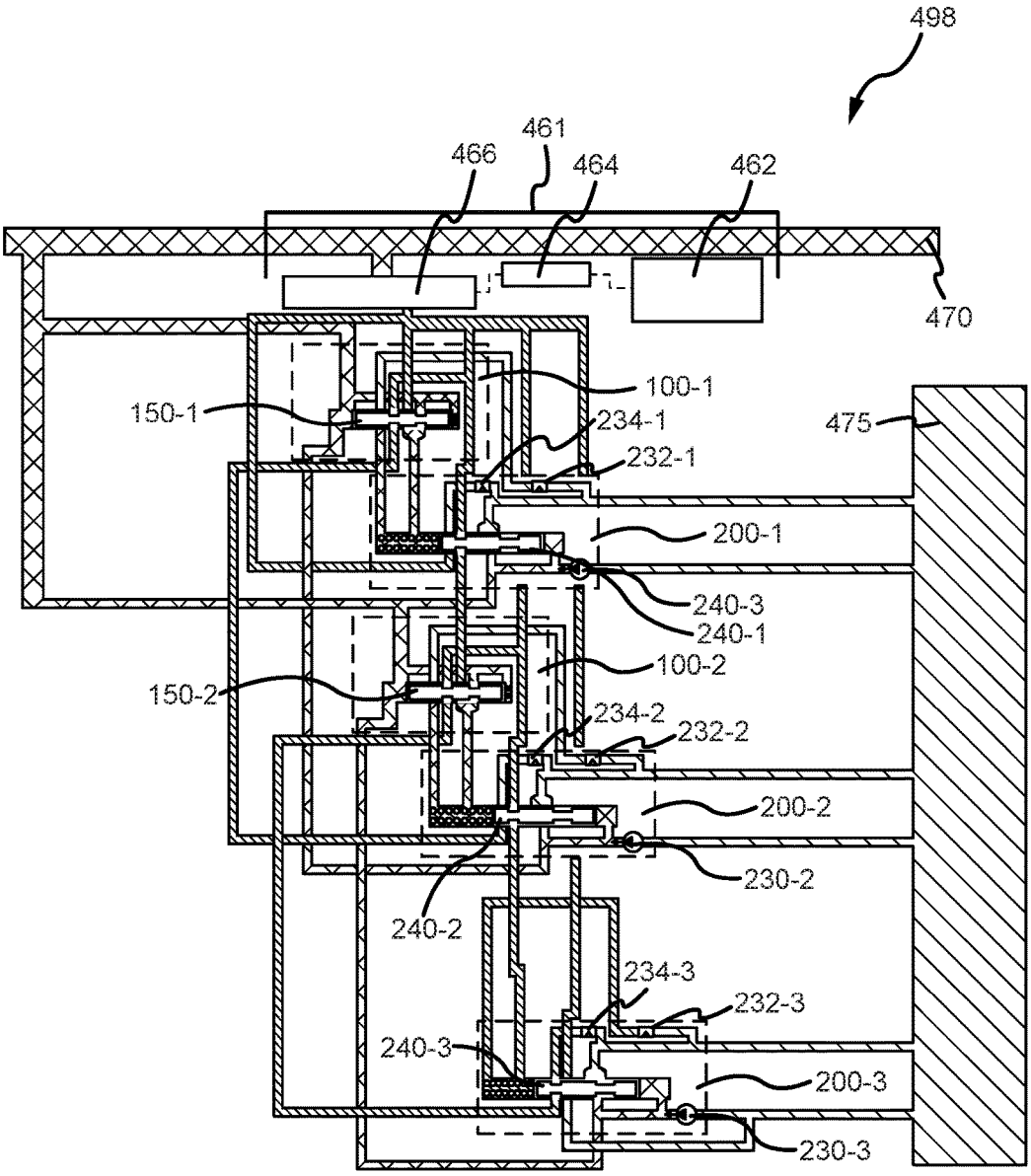
FIG. 4 illustrates a schematic view of a modular multi-pump component system, in accordance with various embodiments.

In various embodiments, and with reference to FIG. 2, a modular component system 95 is disclosed. Modular component system 95 may comprise modular pump system 90 split into a mix component module 100 and a pump component module 200. Mix component module 100 may comprise a portion of modular pump system 90 having a mix valve 150. Pump component module 200 may comprise a portion of modular pump system 90 having a PRV 240. In that regard, modular component system 95 may provide greater modularity when forming a multi-pump sequence. For example, in a modular multi-pump system 397, e.g., as depicted in FIG. 3E, the final pump in the sequence (e.g., third modular pump system 390-3) in a multi-pump sequence does not utilize a mix valve (e.g., third mix valve 350-3) to function. As such, and depending on design and/or weight requirements, it may be beneficial to include only a pump component module 200 for the final pump (e.g., third modular pump system 390-3) in a multi-pump sequence, without including mix component module 100 (e.g., as depicted in FIG. 4).

In various embodiments, mix component module 100 and pump component module 200 may couple together to comprise modular component system 95 having the same capabilities and benefits as modular pump system 90. In that regard, a passage 111 of mix component module 100 may couple to a passage 211 of pump component module 200; a passage 113 of mix component module 100 may couple to a passage 213 of pump component module 200; and a passage 115 of mix component module 100 may couple to a passage 215 of pump component module 200.

In various embodiments, and with reference to FIGS. 3A-3E, a modular multi-pump system 397 is disclosed. Modular multi-pump system 397 may comprise a sequence of modular pump systems (e.g., a first modular pump system 390-1, a second modular pump system 390-2, and a third modular pump system 390-3). During operational conditions where only a portion of the pump capacity is required (e.g., the pump capacity is 30 GPM (113.6 LPM) and the fluid flow demand is 20 GPM (75.7 LPM), first modular pump system 390-1 may generate fluid flow to meet the fluid flow demand. In that regard, second modular pump system 390-2 and third modular pump system 390-3 may be operated at a low pressure differential to minimize efficiency losses due to internal leakage, thereby greatly reducing heat production intrinsic to pressurizing a large amount of unneeded bypass flow. In response to fluid flow demand exceeding the pump capacity of the first modular pump system 390-1, the additional fluid flow associated with meeting the fluid flow demand may be generated by the second modular pump system 390-2. In response to the fluid flow demand exceeding the pump capacity of first modular pump system 390-1 and second modular pump system 390-2, the additional fluid flow associated with meeting the fluid flow demand may be generated by a third modular pump system 390-3. Accordingly, the example modular multi-pump system 397 may provide a smooth transition between modular pump systems during an increase in fluid flow demand, without a lag in response time such that the efficiencies of using a multi-pump system can be utilized.

FIGS. 3A-3E provide an example embodiment of modular multi-pump system 397 having three modular pump systems. Modular multi-pump system 397 may comprise any suitable number of modular pump systems. In that regard, the number of modular pump systems in modular multi-pump system 397 may be scaled based on the fluid flow demand desired. Moreover, each modular pump system may be moved in the multi-pump sequence (e.g., the third modular pump system is moved to be the first modular pump system), reducing the operational wear on modular multi-pump system 397.

In various embodiments, modular multi-pump system 397 may comprise a regulator control assembly 361 configured to control fluid flow through modular multi-pump system 397, such that a desired flow and fluid pressure is maintained at flow demand outlet 370. In various embodiments, regulator control assembly 361 may comprise any suitable pressure setting mechanism, such as, for example, a single-stage servo valve, a hydromechanical controller, a fixed orifice, and/or the like. Regulator control assembly 361 may be implemented as a separate valve body assembly, and/or may also be implemented within an existing housing or valve assembly. In various embodiments, regulator control assembly 361 may comprise a pressure sensing element 362, a controller 364, and/or a variable flow port 366. Pressure sensing element 362, controller 364, and/or variable flow port 366 may be in electronic and/or operative communication with each other.

In various embodiments, pressure sensing element 362 may be configured to monitor the pressure of modular multi-pump system 397. In that regard, pressure sensing element 362 may monitor fluid flow pressure at flow demand outlet 370, and provide pressure data to controller 364. Pressure sensing element 362 may comprise a strain gauge pressure sensor, and/or any other suitable device capable of monitoring fluid flow pressure. In various embodiments, controller 364 may receive the pressure data from pressure sensing element 362 and may send a control signal to variable flow port 366 to provide the desired pressure. In various embodiments, variable flow port 366 may comprise an electro-hydraulic servo valve (EHSV), and/or the like, configured to open and/or close control passages in variable flow port 366, that in turn control a fluid pressure reference for PRV 340-1 and first mix valve 350-1.

In various embodiments, FIG. 3A illustrates a condition wherein first modular pump system 390-1 is regulating fluid pressure and providing fluid flow to flow demand outlet 370, and second modular pump system 390-2 and third modular pump system 390-3 are in a bypass position. For example, in this condition a fluid flow demand may be 20 GPM (75.7 LPM), wherein first modular pump system 390-1 comprises the pump capacity of 30 GPM (113.6 LPM). Pump 330-1 may provide 20 GPM (75.7 LPM) fluid flow, from pump supply 375, to first modular pump system 390-1, and out flow demand outlet 370. PRV 340-1 is in the balanced position to maintain output pressure in first modular pump system 390-1. First mix valve 350-1 is in the first position to prevent fluid flow from modular pump system 390-2 and to maintain pressure balance through first backpressure orifice 332-1 and second backpressure orifice 334-1.

Figure 3B:
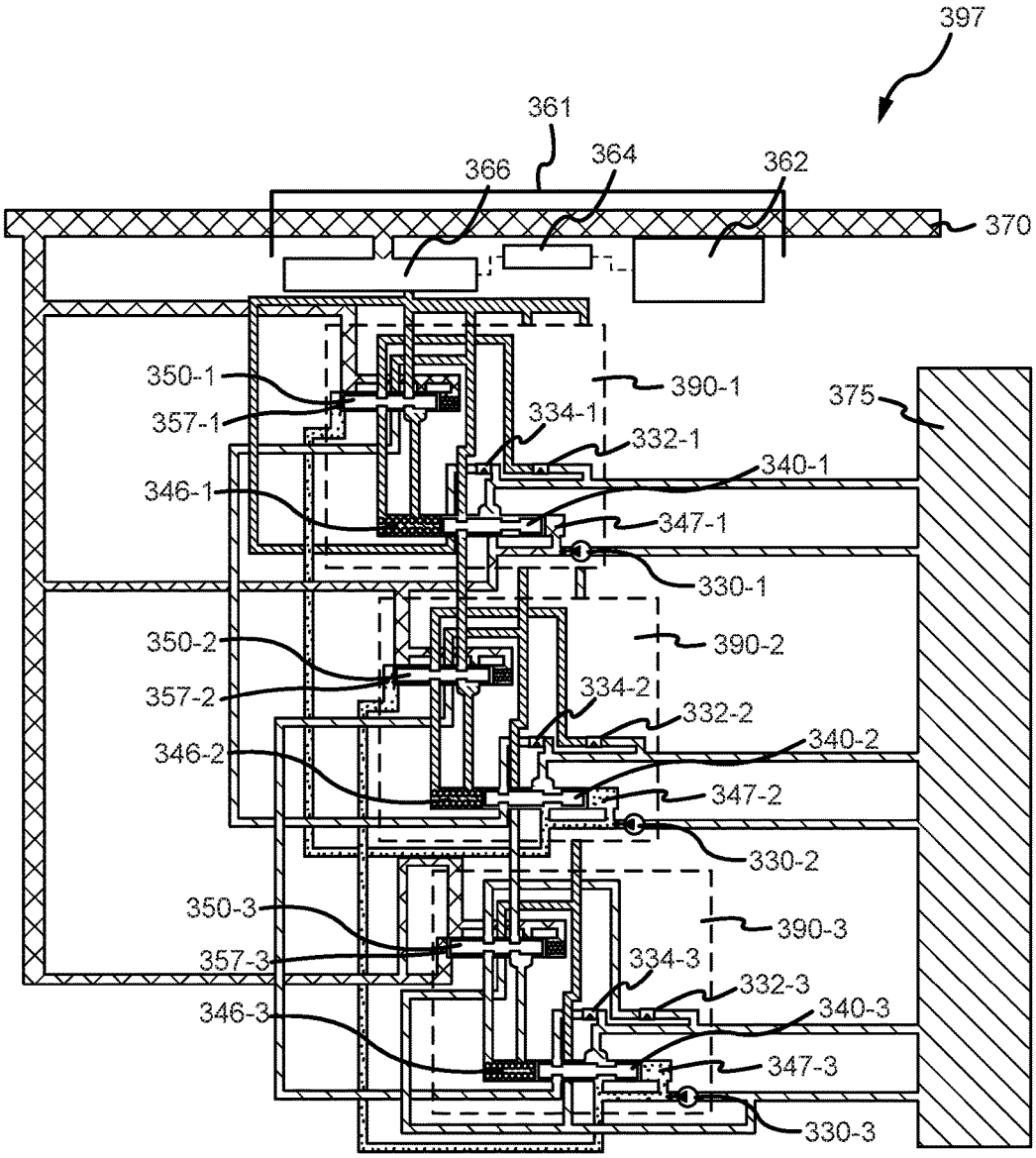
FIG. 3B illustrates a schematic view of a modular multi-pump system with the first modular pump system providing fluid flow in a first transition with a second modular pump system, in accordance with various embodiments.

In various embodiments, FIG. 3B illustrates a condition wherein first modular pump system 390-1 is regulating pressure and providing fluid flow to flow demand outlet 370 and is in a first transition to second modular pump system 390-2, and third modular pump system 390-3 is in a bypass position. For example, in this condition the fluid flow demand may change to 40 GPM (151.4 LPM), wherein first modular pump system 390-1 comprises the pump capacity of 30 GPM (113.6 LPM). In response to first modular pump system 390-1 reaching full output of the pump capacity, pressure may decrease in passage 347-1, causing PRV 340-1 to move into the transition position. In the transition position, PRV 340-1 initiates the first transition to second modular pump system 390-2 allowing fluid flow through to second modular pump system 390-2. First mix valve 350-1 remains in the first position to prevent fluid flow from modular pump system 390-2 and to maintain pressure balance through first backpressure orifice 332-1 in first modular pump system 390-1, and first backpressure orifice 332-2 in second modular pump system 390-2.

Figure 3C:
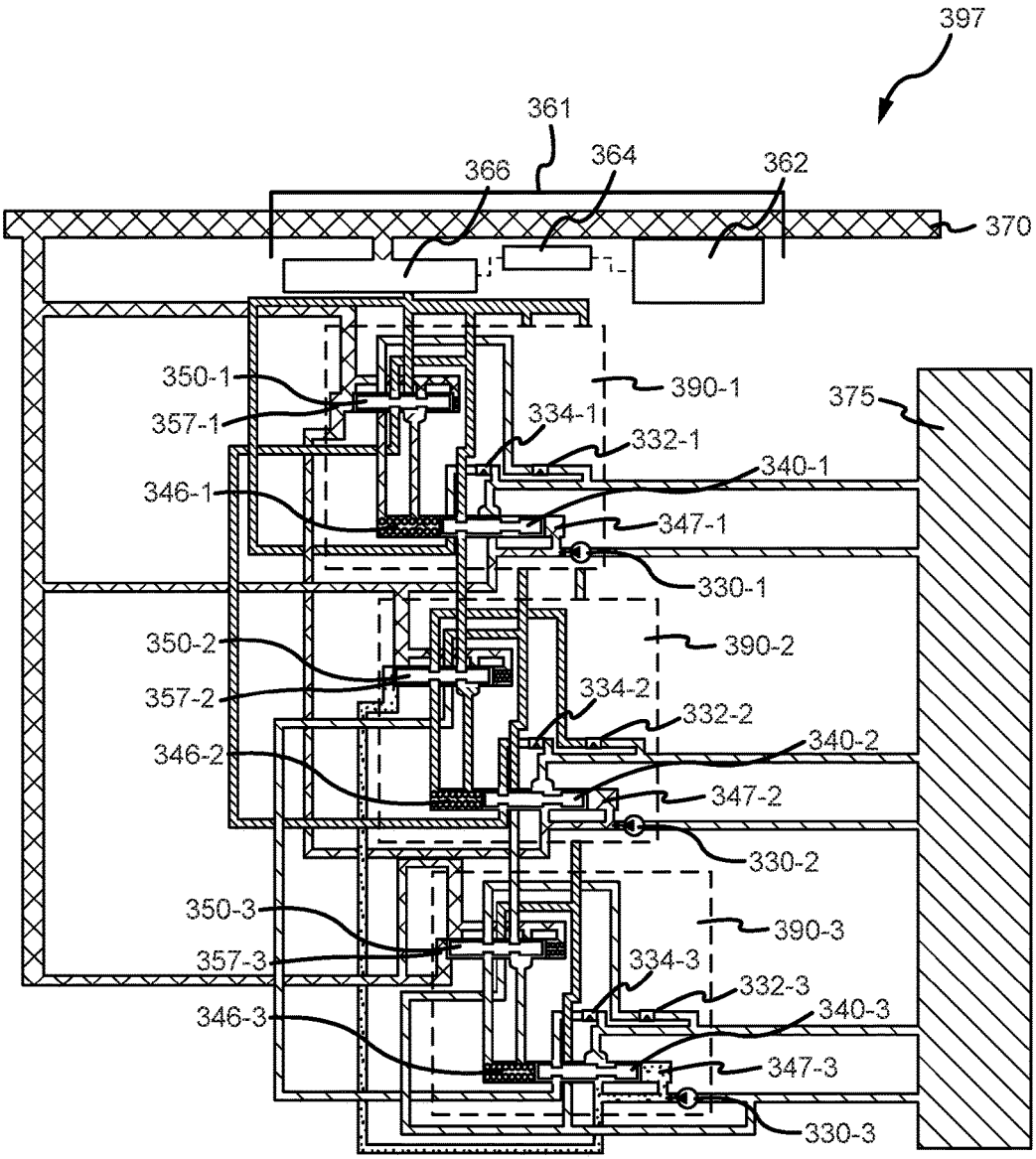
FIG. 3C illustrates a schematic view of a modular multi-pump system with the first modular pump system and the second modular pump system providing fluid flow, in accordance with various embodiments.

In various embodiments, FIG. 3C illustrates a condition wherein first modular pump system 390-1 and second modular pump system 390-2 are regulating pressure and providing fluid flow to flow demand outlet 370, and third modular pump system 390-3 is in a bypass position. For example, in this condition the fluid flow demand may be 40 GPM (151.4 LPM), wherein first modular pump system 390-1 comprises the pump capacity of 30 GPM (113.6 LPM) and second modular pump system 390-2 comprises the pump capacity of 30 GPM (113.6 LPM). Pump 330-1 may provide 30 GPM (113.6 LPM) fluid flow, from pump supply 375, to first modular pump system 390-1, and out flow demand outlet 370. Pump 330-2 may also provide 10 GPM (37.8 LPM) fluid flow, from pump supply 375, to second modular pump system 390-2.

In response to second modular pump system 390-2 providing fluid flow, pressure may increase in passage 357-1 causing mix valve 350-1 to move into the second position. In the second position, mix valve 350-1 will enable fluid flow from second modular pump system 390-2 to flow out flow demand outlet 370, thus meeting the fluid flow demand of 40 GPM. The second position will also increase fluid pressure in passage 346-1 causing PRV 340-1 to not regulate second modular pump system 390-2. PRV 340-1 will remain in the transition position. PRV 340-2 is in the balanced position to maintain output pressure in second modular pump system 390-2. Mix valve 350-2 is in the first position to prevent fluid flow from third modular pump system 390-3 and to maintain pressure balance through first backpressure orifice 332-2 and second backpressure orifice 334-2.

Figure 3D:
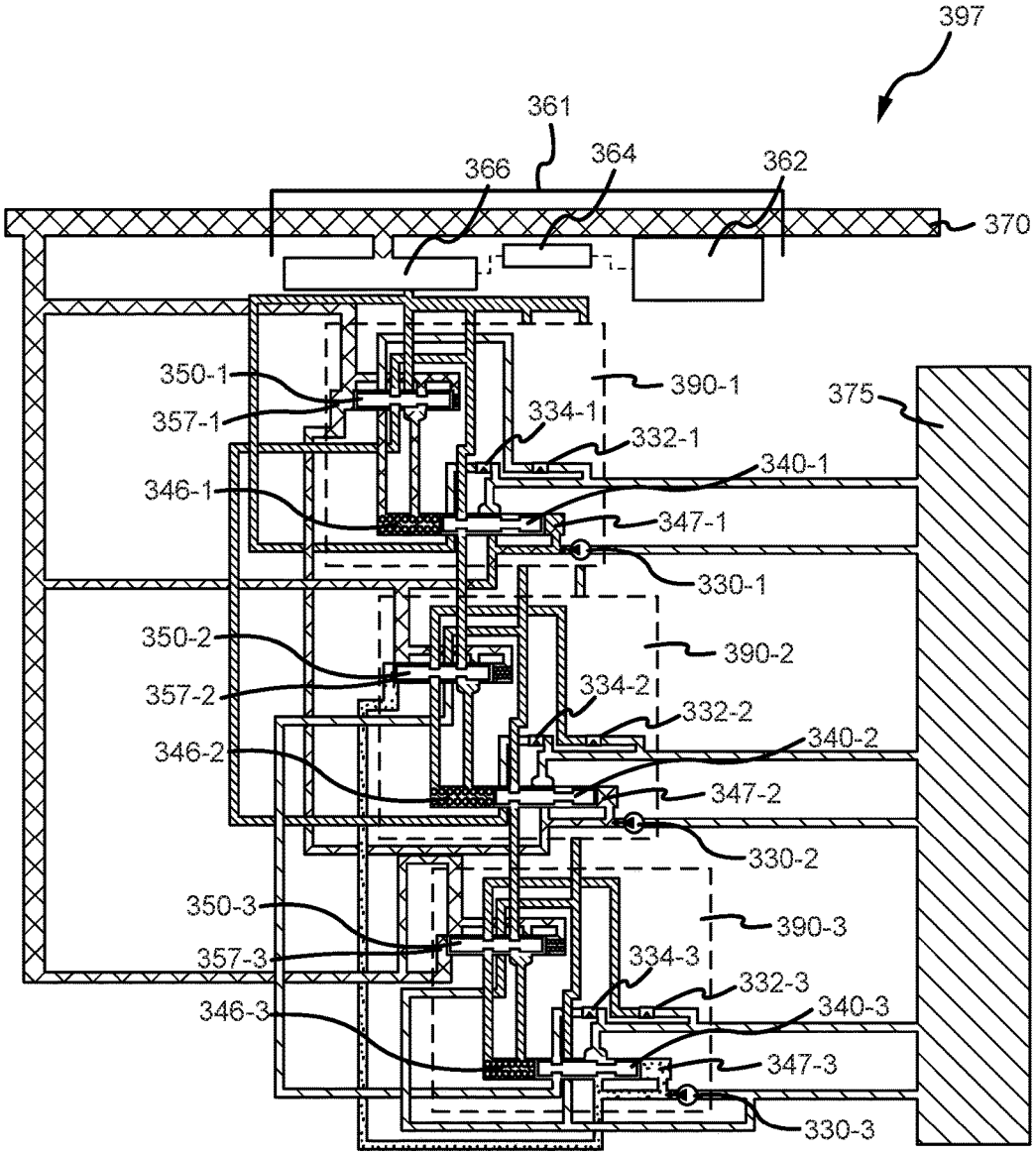
FIG. 3D illustrates a schematic view of a modular multi-pump system with the first modular pump system and the second modular pump system providing fluid flow in a second transition with a third modular pump system, in accordance with various embodiments.

In various embodiments, FIG. 3D illustrates a condition wherein first modular pump system 390-1 and second modular pump system 390-2 are regulating pressure and providing fluid flow to flow demand outlet 370, and second modular pump system 390-2 is in a second transition with third modular pump system 390-3. For example, in this condition the fluid flow demand may be 80 GPM (302.8 LPM), wherein first modular pump system 390-1 comprises the pump capacity of 30 GPM (113.6 LPM) and second modular pump system 390-2 comprises the pump capacity of 30 GPM (113.6 LPM). In response to second modular pump system 390-2 reaching full output of the pump capacity, pressure may decrease in passage 347-2, causing PRV 340-2 to move into the transition position. In the transition position, PRV 340-2 initiates the second transition to third modular pump system 390-3 allowing fluid flow through to third modular pump system 390-3. Mix valve 350-2 remains in the first position to prevent fluid flow from modular pump system 390-3 and to maintain pressure balance through first backpressure orifice 332-2 in second modular pump system 390-2, and first backpressure orifice 332-3 in third modular pump system 390-3. PRV 340-1 remains in the transition position, and mix valve 350-1 remains in the second position.

In various embodiments, FIG. 3E illustrates a condition wherein first modular pump system 390-1, second modular pump system 390-2, and third modular pump system 390-3 are regulating pressure and providing fluid flow to flow demand outlet 370. For example, in this condition a fluid flow demand may be 80 GPM (302.8 LPM), wherein first modular pump system 390-1 comprises the pump capacity of 30 GPM (113.6 LPM), second modular pump system 390-2 comprises the pump capacity of 30 GPM (113.6 LPM), and third modular pump system 390-3 comprises the pump capacity of 30 GPM (113.6 LPM). Pump 330-1 may provide 30 GPM (113.6 LPM) fluid flow, from pump supply 375, to first modular pump system 390-1, and out flow demand outlet 370. Pump 330-2 may also provide 30 GPM (113.6 LPM) fluid flow, from pump supply 375, to second modular pump system 390-2, and out flow demand outlet 370. Pump 330-3 may also provide 20 GPM (75.7 LPM) fluid flow, from pump supply 375, to third modular pump system 390-3.

In response to third modular pump system 390-3 providing fluid flow, pressure may increase in passage 357-2 causing mix valve 350-2 to move into the second position. In the second position, mix valve 350-2 will enable fluid flow from second modular pump system 390-3 to flow out flow demand outlet 370, thus meeting the fluid flow demand of 80 GPM (302.8 LPM). The second position will also increase fluid pressure in passage 346-2 causing PRV 340-2 to not regulate third modular pump system 390-3. PRV 340-1 and PRV 340-2 will remain in the transition position. PRV 340-3 is in the balanced position to maintain output pressure in third modular pump system 390-3. Mix valve 350-1 will remain in the second position, and mix valve 350-3 is in the first position to maintain pressure balance through first backpressure orifice 332-3 and second backpressure orifice 334-3.

In various embodiments, and with reference to FIG. 4, a modular multi-pump component system 498 is disclosed. FIG. 4 provides an example embodiment of modular multi-pump component system 398 having three pump component modules (a first pump component module 200-1, a second pump component module 200-2, and a third pump component module 200-3) together with two mix component modules (a first mix component module 100-1 and a second mix component module 100-2). Modular multi-pump component system 498 may function similarly to modular multi-pump system 397, with reference to FIGS. 3A-3E, using the same methods and operations to control fluid flow.

Modular multi-pump component system 398 may comprise any suitable number of pump component modules and mix component modules. In that regard, the number of pump component modules and mix component modules may be scaled based on the fluid flow demand desired. Moreover, modular multi-pump component system 398 may be combined with modular multi-pump system 397 to comprise a system having modular pump systems (e.g., modular pump system 90) and component modules (e.g., pump component module 200 and mix component module 100). In that regard, an example system may comprise a first modular pump system, a second modular pump system, and a pump component module.

Benefits, other advantages, and solutions to problems have been described herein with regard to specific embodiments. Furthermore, the connecting lines shown in the various figures contained herein are intended to represent exemplary functional relationships and/or physical couplings between the various elements. It should be noted that many alternative or additional functional relationships or physical connections may be present in a practical system. However, the benefits, advantages, solutions to problems, and any elements that may cause any benefit, advantage, or solution to occur or become more pronounced are not to be construed as critical, required, or essential features or elements of the disclosures. The scope of the disclosures is accordingly to be limited by nothing other than the appended claims and their legal equivalents, in which reference to an element in the singular is not intended to mean "one and only one" unless explicitly so stated, but rather "one or more." Moreover, where a phrase similar to "at least one of A, B, or C" is used in the claims, it is intended that the phrase be interpreted to mean that A alone may be present in an embodiment, B alone may be present in an embodiment, C alone may be present in an embodiment, or that any combination of the elements A, B and C may be present in a single embodiment; for example, A and B, A and C, B and C, or A and B and C.

Systems, methods and apparatus are provided herein. In the detailed description herein, references to "various embodiments", "one embodiment", "an embodiment", "an example embodiment", etc., indicate that the embodiment described may include a particular feature, structure, or characteristic, but every embodiment may not necessarily include the particular feature, structure, or characteristic. Moreover, such phrases are not necessarily referring to the same embodiment. Further, when a particular feature, structure, or characteristic is described in connection with an embodiment, it is submitted that it is within the knowledge of one skilled in the art to affect such feature, structure, or characteristic in connection with other embodiments whether or not explicitly described. After reading the description, it will be apparent to one skilled in the relevant art(s) how to implement the disclosure in alternative embodiments.

Furthermore, no element, component, or method step in the present disclosure is intended to be dedicated to the public regardless of whether the element, component, or method step is explicitly recited in the claims. No claim element is intended to invoke 35 U.S.C. 112(f) unless the element is expressly recited using the phrase "means for." As used herein, the terms "comprises", "comprising", or any other variation thereof, are intended to cover a non-exclusive inclusion, such that a process, method, article, or apparatus that comprises a list of elements does not include only those elements but may include other elements not expressly listed or inherent to such process, method, article, or apparatus.

What is claimed is:

1. A modular multi-pump system, comprising:

a first modular pump system, including a first pump configured to provide a first fluid flow through the first modular pump system and to a flow demand outlet, a first pressure regulating valve configured to move between a balanced position and a transition position, wherein in the balanced position the first pressure regulating valve maintains a fluid output pressure to the flow demand outlet, and in the transition position the first pressure regulating valve initiates a second fluid flow from a second modular pump system to be received by the first modular pump system and added to the flow demand outlet, and a mix valve configured to move between a first position and a second position, wherein in the first position the mix valve prevents the second fluid flow from the second modular pump system from entering the first modular pump system, and in the second position the mix valve enables the second fluid flow from the second modular pump system to enter the first modular pump system and be added with the first fluid flow at the flow demand outlet, the mix valve including a primary control window configured to fluidly couple a variable flow port with the first pressure regulating valve when in the first position and the flow demand outlet with the first pressure regulating valve when in the second position; and the second modular pump system, including a second pump configured to provide the second fluid flow through the second modular pump system and the first modular pump system and to the flow demand outlet.

2. The modular multi-pump system of claim 1, further comprising a first backpressure orifice and a second backpressure orifice configured to maintain a fluid pressure on the pressure regulating valve.

3. The modular multi-pump system of claim 1, further comprising a regulator control assembly to control fluid flow to the flow demand outlet.

4. The modular multi-pump system of claim 3, wherein the regulator control assembly comprises a pressure sensing element, a controller, and the variable flow port.

5. The modular multi-pump system of claim 1, wherein the first pressure regulating valve and the mix valve each comprise spool valves movable within a cavity in response to a fluid pressure applied at each end.

6. The modular multi-pump system of claim 1, wherein the first pressure regulating valve comprises a secondary bypass control window configured to selectively allow fluid flow through the first pressure regulating valve.

7. The modular multi-pump system of claim 1, wherein the second modular pump system includes a second pressure regulating valve and a second mix valve.

8. A modular component system for providing a fluid flow to a flow demand outlet, comprising:

a pump component module, comprising:

a pump configured to provide fluid flow through the pump component module;

a pressure regulating valve configured to move between a balanced position and a transition position, wherein in the balanced position the pressure regulating valve maintains a fluid output pressure for the pump component module, and in the transition position the pressure regulating valve initiates a fluid flow transition to a second modular pump system; and a first backpressure orifice and a second backpressure orifice configured to maintain a fluid pressure on the pressure regulating valve; and a mix component module, comprising:

a mix valve configured to move between a first position and a second position, wherein in the first position the mix valve prevents fluid flow from the second modular pump system and in the second position the mix valve enables fluid flow from the second modular pump system, wherein the mix valve includes a primary control window configured to fluidly couple a variable flow port with the pressure regulating valve when in the first position and the flow demand outlet with the pressure regulating valve when in the second position.

9. The modular component system of claim 8, further comprising a regulator control assembly to control fluid flow to the flow demand outlet.

10. The modular component system of claim 9, wherein the regulator control assembly comprises a pressure sensing element, a controller, and the variable flow port.

11. The modular component system of claim 8, wherein the pressure regulating valve and the mix valve each comprise spool valves movable within a cavity in response to a fluid pressure applied at each end.

12. The modular component system of claim 8, wherein the pressure regulating valve comprises a secondary bypass control window configured to selectively allow fluid flow through the pressure regulating valve.

13. The modular component system of claim 8, wherein the mix valve comprises a secondary control window configured to selectively allow fluid flow through the mix valve.

14. A modular multi-pump system for providing a fluid under pressure to a flow demand outlet, comprising:

at least one modular pump system, comprising:

a first pump configured to provide a first fluid flow through the at least one modular pump system;

a pressure regulating valve configured to move between a balanced position and a transition position, wherein in the balanced position the pressure regulating valve maintains a fluid output pressure for the at least one modular pump system, and in the transition position the pressure regulating valve initiates a fluid flow transition; and a mix valve configured to move between a first position and a second position, wherein in the first position the mix valve prevents flow of a second fluid flow, and in the second position the mix valve enables flow of the second fluid flow, wherein the mix valve includes a primary control window configured to fluidly couple a variable flow port with the pressure regulating valve when in the first position and the flow demand outlet with the pressure regulating valve when in the second position; and a pump component module, comprising:

a second pump configured to provide the second fluid flow through the pump component module;

a component pressure regulating valve configured to move between a balanced position and a transition position, wherein in the balanced position a pressure regulating valve maintains a fluid output pressure for the pump component module, and in the transition position the pressure regulating valve initiates a fluid flow to a pump supply; and a first backpressure orifice and a second backpressure orifice configured to maintain a fluid pressure on the component pressure regulating valve.

15. The modular multi-pump system of claim 14, further comprising a regulator control assembly to control fluid flow to the flow demand outlet.

16. The modular multi-pump system of claim 15, wherein the regulator control assembly comprises a pressure sensing element, a controller, and the variable flow port.

17. The modular multi-pump system of claim 14, wherein the pressure regulating valve, the component pressure regulating valve, and the mix valve each comprise spool valves movable within a cavity in response to a fluid pressure applied at each end.

18. The modular multi-pump system of claim 14, wherein the pressure regulating valve and the component pressure regulating valve each comprise a primary bypass control window and a secondary bypass control window configured to selectively allow fluid flow through each respective valve.

19. The modular multi-pump system of claim 14, wherein the mix valve comprises a secondary control window configured to selectively allow fluid flow through the mix valve.

20. The modular multi-pump system of claim 14, wherein the pump supply comprises at least one of an inner stage pump, a boost pump, a fluid supply tank, and a bypass flow tank.

* * * * *